US006729087B2

(12) United States Patent
Sauter

(10) Patent No.: US 6,729,087 B2
(45) Date of Patent: May 4, 2004

(54) TWO-PART SEPARABLE BASE MOLDING

(76) Inventor: Mark J. Sauter, 1322 Joyce Ave., Palatine, IL (US) 60067

( * ) Notice: Subject to any disclaimer, the term of this patent is extended or adjusted under 35 U.S.C. 154(b) by 0 days.

(21) Appl. No.: 10/056,568

(22) Filed: Jan. 25, 2002

(65) Prior Publication Data

US 2003/0140583 A1 Jul. 31, 2003

(51) Int. Cl.[7] ..... E04F 19/04

(52) U.S. Cl. ..... 52/290; 52/287.1; 52/716.1; 52/717.05; 52/242

(58) Field of Search ..... 52/290, 287.1, 52/288.1, 716.1, 717.04, 717.05, 220.1, 220.5, 220.7, 242

(56) References Cited

U.S. PATENT DOCUMENTS

| | | | | |
|---|---|---|---|---|
| 1,936,507 A | | 11/1933 | Green | |
| 1,963,662 A | | 6/1934 | Knapp | |
| 2,203,119 A | | 6/1940 | Wollaeger | |
| 2,316,980 A | * | 4/1943 | Sigloch et al. | 52/242 |
| 2,478,006 A | | 8/1949 | Paden | |
| 3,201,909 A | | 8/1965 | Grun | |
| 3,228,160 A | | 1/1966 | O'Brien | |
| 3,286,422 A | | 11/1966 | Pangerl | |
| 3,422,584 A | * | 1/1969 | Howard | 52/98 |
| 3,448,552 A | | 6/1969 | Schmitt et al. | |
| 3,449,873 A | | 6/1969 | Damato et al. | |
| 3,464,177 A | | 9/1969 | Amato | |
| 3,707,061 A | | 12/1972 | Collette et al. | |
| 3,911,637 A | | 10/1975 | Schmidlger | |
| 4,037,900 A | | 7/1977 | Schmidger | |
| 4,204,376 A | | 5/1980 | Calvert | |
| 4,461,135 A | | 7/1984 | Anderson et al. | |
| 4,565,041 A | | 1/1986 | Wendt | |
| 4,569,171 A | | 2/1986 | Kuhr et al. | |
| 4,800,699 A | | 1/1989 | Lang | |
| 4,845,910 A | | 7/1989 | Hanson et al. | |
| 4,986,332 A | | 1/1991 | Lanuza | |
| 5,243,800 A | | 9/1993 | Olbirch | |
| 5,274,972 A | * | 1/1994 | Hansen | 52/220.5 |
| 5,598,681 A | | 2/1997 | DiGianni | |
| 5,694,726 A | | 12/1997 | Wu | |
| 5,752,356 A | | 5/1998 | Miklavic et al. | |
| 6,122,872 A | * | 9/2000 | Sauter | 52/288.1 |
| 6,545,214 B2 | * | 4/2003 | Russell et al. | 174/48 |

FOREIGN PATENT DOCUMENTS

| | | |
|---|---|---|
| CA | 835019 | 2/1970 |
| CH | 362512 | 7/1962 |
| FR | 1317930 | 1/1963 |
| GB | 1032103 | 6/1966 |
| GB | 1144551 | 3/1969 |
| IT | 618898 | 3/1961 |
| IT | 713249 | 9/1966 |

* cited by examiner

*Primary Examiner*—Carl D. Friedman
*Assistant Examiner*—Naoko Stack
(74) *Attorney, Agent, or Firm*—Welsh & Katz, Ltd.

(57) ABSTRACT

A two-part base molding system includes mounting and molding portions. The mounting portion includes at least one mounting engaging element extending therefrom. The mounting portion has an outer surface, and the mounting engaging element has inner and outer surfaces. The molding portion is mountable to the mounting portion, and includes at least one molding engaging element extending therefrom. The molding portion has a rear surface, and the molding engaging element has inner and outer surfaces. When the molding portion is mounted to the mounting portion, the inner surfaces of the mounting and molding engaging elements substantially abut one another, and the outer surface of the mounting engaging elements substantially abuts the rear surface of the molding portion.

18 Claims, 2 Drawing Sheets

TWO-PART SEPARABLE BASE MOLDING

BACKGROUND OF THE INVENTION

This invention pertains to a two-part base molding. More particularly, this invention pertains to a two-part wall base molding system in which a visible molding portion is separable from a wall mount to readily permit removing the visible base molding portion.

Wall base moldings are commonly used where a wall meets a floor to provide a neat and acceptable appearance at the wall-floor juncture. Moldings are made from a variety of materials, using a variety of methods. One commonly used type of molding is made from a polymeric material, such as polyvinyl chloride (PVC) that is extruded in a well known process. Extruded PVC molding is typically a cost effective building material that can be provided in an array of colors and styles.

Moldings are also used to hide an abundance of imperfections and inconsistencies in a wall finish. That is, where walls are not finished to the floor, low spots, wall openings, and the like could otherwise be visible without the use of a base molding. In many instances, it may also be advantageous to position narrow gauge cabling, such as telephone wiring between a molding and the wall to reduce or eliminate what could otherwise be an unsightly appearance.

Various types of extruded moldings, both permanent and removable are known in the art. Those skilled in the art will recognize that permanent types of moldings have a variety of drawbacks. First, permanent moldings cannot be easily removed. Typically, these moldings are affixed to the wall using an adhesive, which upon removing the molding from the wall, will often remove a portion of the wall with the molding. Even if the molding is removed without damaging the wall, the adhesive may be so well adhered to the wall, that in removing the remaining adhesive, the wall becomes damaged. Moreover, if the molding requires replacement due to age or damage, or a change in color is desired, these same problems are encountered.

In addition, when painting, it is necessary to carefully tape or otherwise protect moldings so that cleanup is minimized or reduced. The time needed to protect such moldings can be time consuming, labor intensive and costly.

One known type of removable molding includes a mechanical hook and loop fastening system, such as VELCRO® brand strips to mount the molding to the wall. In such an arrangement, one of the portions or strips of the fastening system is affixed to the wall and the other is affixed to the molding. The molding is then mounted to the wall by joining the fastening strips to one another. Although this type of system is adequate to mount the molding to the wall, the molding requires proper alignment to assure that the molding is properly mounted to the wall. In addition, most consumers will recognize that these mechanical hook and loop fastening strips may not maintain a tight "fit" of the molding to the wall, and can lose their effectiveness over time, particularly when subjected to dust, lint and like debris.

Accordingly, there is a need for a removable wall base molding system that permits ready installation. Desirably, such a system is provided in a two-part assembly that is self-aligning when installed. Most desirably such a system maintains a strong, structurally sound mounting of the molding to the wall, and permits the installation of small gauge cabling or wires between the molding and the wall to reduce or eliminate unsightly, visible wiring.

SUMMARY OF THE INVENTION

The invention relates to a two-part base molding system comprising a mounting portion and a molding portion. Several embodiments of the mounting and molding portion are contemplated.

The mounting portion can include solid upper and lower portions vertically spaced from one another, and a plurality of fastener openings that are formed within the mounting portion. The fastener openings can be positioned at the vertical space between the upper and lower solid portions. In one embodiment, the upper mounting portion includes a first continuous mounting engaging element extending therefrom, and the lower portion includes a second continuous mounting engaging element extending therefrom. In another embodiment, the upper mounting portion includes a first set of discrete mounting engaging elements extending therefrom, and the lower portion includes a second set of discrete mounting engaging elements extending therefrom. The mounting portion has an outer surface, and both the first and second continuous mounting engaging elements, and the first and second sets of discrete mounting engaging elements have inner and outer surfaces.

The mounting portion can also include a continuous spacing element or a plurality of discrete spacing elements depending from a lower end of the mounting portion.

The molding portion includes first and second continuous molding engaging elements extending therefrom in yet another alternate embodiment. In still another alternate embodiment, the molding portion includes first and second sets of discrete molding engaging elements extending therefrom. The first and second molding engaging elements are vertically spaced from one another. The molding portion has a rear surface, and the first and second molding engaging elements (both the continuous and sets of discrete molding engaging elements) have inner and outer surfaces.

When the molding portion is mounted to the mounting portion, the inner surfaces of the first and second mounting and molding engaging elements substantially abut one another, and the outer surfaces of the first and second mounting engaging elements substantially abut the rear surface of the molding portion.

DETAILED DESCRIPTION OF THE INVENTION

Figure 1:
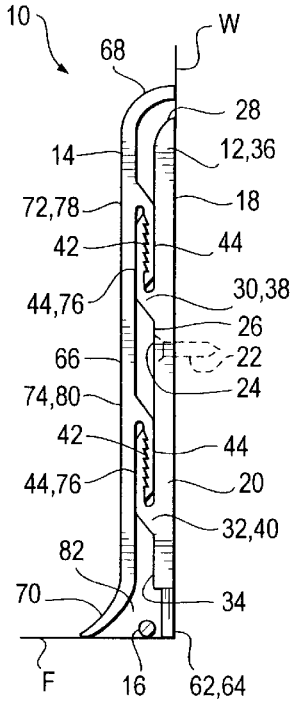
FIG. 1 is a cross-sectional view of a two-part separable base molding system embodying the principles of the present invention illustrated with the molding and mounting portions connected to one another.

While the present invention is susceptible of embodiment in various forms, there is shown in the drawings and will hereinafter be described a specific embodiment with the understanding that the present disclosure is to be considered an exemplification of the invention and is not intended to limit the invention to the specific embodiment illustrated.

It should be further understood that the title of this section of this specifically, normally, "Detailed Description of the Invention," relates to a requirement of the United States Patent and Trademark Office, and does not imply, nor should be referred to limit the subject matter disclosed and claimed herein.

Referring now to FIG. 1, there is shown one embodiment of a two-part, separable base molding system 10 in accordance with the principles of the present invention. The molding system 10 includes, generally, a wall mounting portion 12, 36 and a molding portion 14. The wall mounting portion 12, 36 referred to herein as "the mount" 12, 36, is configured for permanent or semi-permanent installation to a wall W to which the system 10 is affixed. The molding portion 14 mechanically mounts to the mount 12, 36, and when mounted, provides a visually appealing, aesthetically pleasing appearance. The molding portion 14 is readily mounted to and removed from the mount 32 so that it can be removed to, for example, perform maintenance to the wall W or to a component behind the wall, or to install or change wiring 16 between the molding and the wall W.

Figure 2:
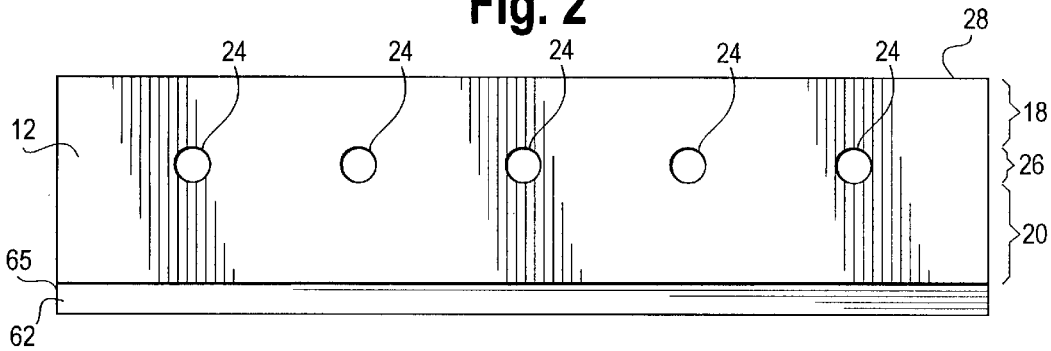
FIG. 2 is a front view of a first embodiment of a mounting portion—which can serve as the mounting portion shown in FIG. 1—embodying aspects of the invention, and showing a continuous leg.

In a first embodiment of the mount 12 shown in FIG. 2, the wall mount 12 is formed from upper and lower portions 18, 20 that are vertically spaced from one another. In the first embodiment 12, the upper and lower portions 18, 20 are preferably solid. It should be noted that, in the context of the upper and lower portions 18, 20, "solid" simply means free from voids or openings. For purposes of upper and lower portions 18, 20, the term "solid" does encompass upper and lower portions 18, 20 that are made from a hollow material.

The mount of the first embodiment 12 (or of the alternate wall mounting portion embodiment 36, described below) can be mounted to the wall W using a variety of methods, such a liquid adhesives and the like. Preferably, the mount 12 is affixed to the wall W using mechanical fasteners 22 (FIG. 1), such as screws, that are received in fastener openings 24 formed in the mount 12. In the first embodiment 12, the fastener openings 24 can be formed at the vertical space 26 that separates the upper and lower portions 18, 20 from one another. In a current configuration of the first embodiment 12, the vertical space 26 separating the upper and lower portions 18, 20 is about 19 mm.

In a preferred embodiment, the fastener openings 24 are elongated or slotted to permit adjusting the height of the mount 12 relative to the floor F, and in a most preferred embodiment, the fastener openings 24 are countersunk, allowing for cooperation with drywall type screws. An upper edge 28 of the mount can be rounded or angled.

At least one, and preferably a pair of continuous mounting engaging elements 30, 32 or corresponding sets of discrete mounting engaging elements 38, 40 extend outwardly from an outer surface 34 of the mount 12, 36. In either case, the mounting engaging elements 30, 32, 38, 40 are vertically spaced from one another. In the first embodiment shown in FIGS. 1–2, a first continuous mounting engaging element 30 extends from the upper portion 18 of the mount 12 and a second continuous mounting engaging element 32 extends from the lower portion 20 of the mount 12. Thus, in the first embodiment, the first and second mounting engaging elements 30, 32 are vertically spaced from one another.

Figure 3:
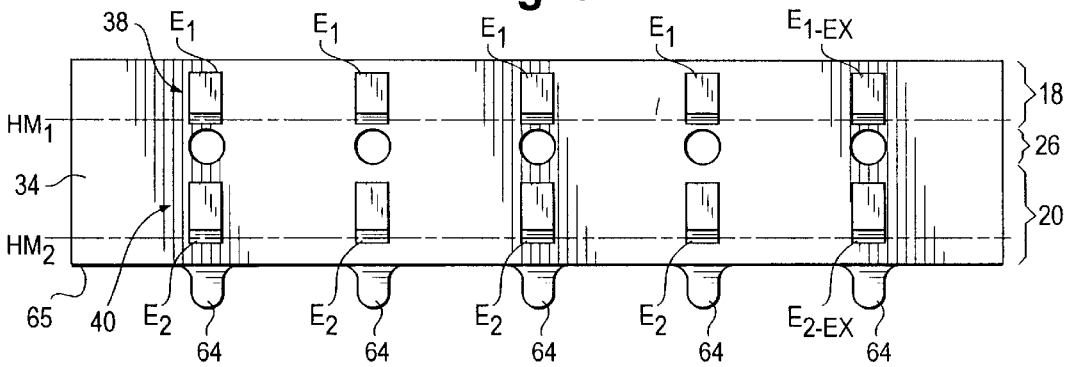
FIG. 3 is a rear view of an alternate embodiment of a mounting portion—which can serve as the mounting portion of FIG. 1—embodying aspects of the invention, showing an outer surface of the mounting portion, and discrete legs.

The alternate mounting portion embodiment 36 shown is FIG. 3 incorporates first and second sets of discrete mounting engaging elements 38, 40 that are vertically spaced from one another. Specifically, the first and second sets 38, 40 extend from the upper and lower mounting portions 18, 20, respectively. In a most preferred version of the alternate embodiment, each element $E_1$, $E_2$ of the first and second sets of discrete mounting engaging elements 38, 40 are vertically aligned so that each element is positioned along first and second horizontal mounting lines $HM_1$, $HM_2$ respectively. Each element $E_1$ of the first set of discrete mounting engaging elements 38 is also horizontally aligned with a corresponding element $E_2$ of the second set of discrete mounting engaging elements 40. For example, a mounting engaging element $E_{1\text{-}EX}$ from the first set 38 is horizontally aligned with a corresponding mounting engaging element $E_{2\text{-}EX}$ from the second set 40. Whether continuous mounting elements 30, 32 or set(s) of discrete mounting elements 38, 40 are used, the mounting engaging elements 30, 32, 38, 40 each include outer and inner surfaces 42, 44 (FIG. 1).

Figure 4A:
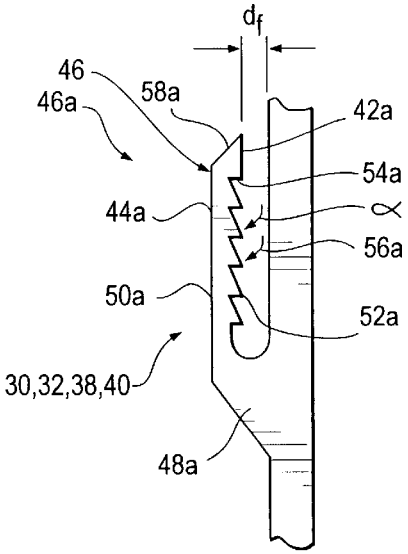
FIG. 4*a* is a cross sectional view of a preferred hook-like version of a mounting engaging element embodying aspects of the invention.
Figure 4B:
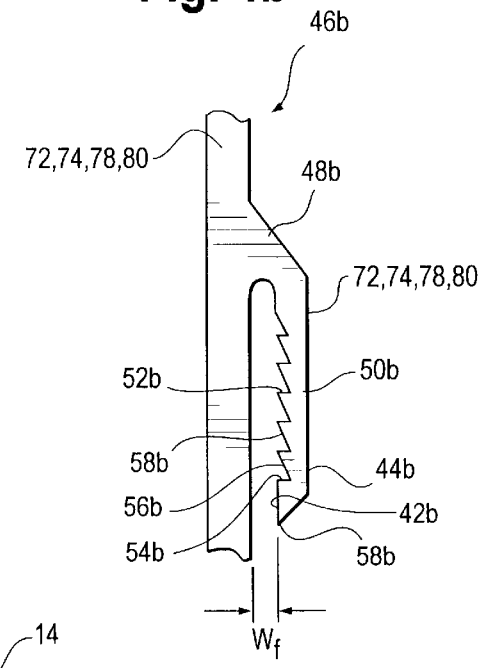
FIG. 4*b* is a cross sectional view of a preferred hook-like version of a molding engaging element embodying aspects of the invention; and, FIGS. 5, and 5*a*–5*b* are cross-sectional and rear views of a molding portion showing both discrete (FIG. 5*a*) and continuous (FIG. 5*b*) molding engaging elements.

Referring to FIG. 4*a,* in a preferred version of the first and alternate embodiments 12, 36, the engaging elements 30, 32, 38, 40 have a hook-like shape. The hook like shape engaging elements 46 include a base portion 48*a* extending transversely from the upper and lower portions 18, 20 of the mount 12, 36, and a free leg portion 50*a* extending from the base 48*a,* generally parallel to the mount 12, 36. In the most preferred version, the inner surface 42 (FIG. 1) is an engaging surface 42*a* including a plurality of serrations 52*a* or teeth 52*a* formed thereon. The serrations 52*a*, which are formed along substantially the entirety of the engaging surface 42*a,* are defined by a steep angle face 54*a* and a shallow angle face 56*a.* In a current embodiment, an angle $\alpha$ is defined by the steep and shallow angle faces of about 65° to about 90° and most preferably about 74°. Preferably, as shown in FIG. 4*a,* the free leg portions 50*a* are slightly tapered and terminate at a point 58*a.*

Referring again to FIGS. 1–3, preferably, the mounting portion 12 includes at least one spacing element 62, 64, such as a leg, depending from about the lower edge 65 of the mounting portion. There can be one continuous leg 62 that extends the length of the mount 12, or there can be a plurality of legs 64 horizontally spaced from one another, as shown in FIGS. 2–3.

Figure 5:
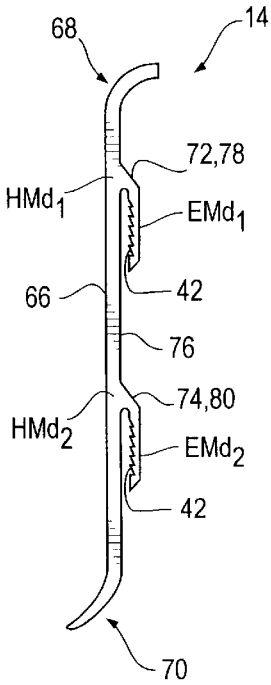
Figure 5A:
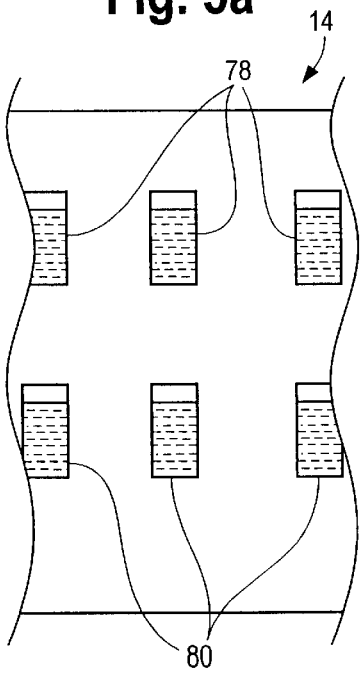
Figure 5B:
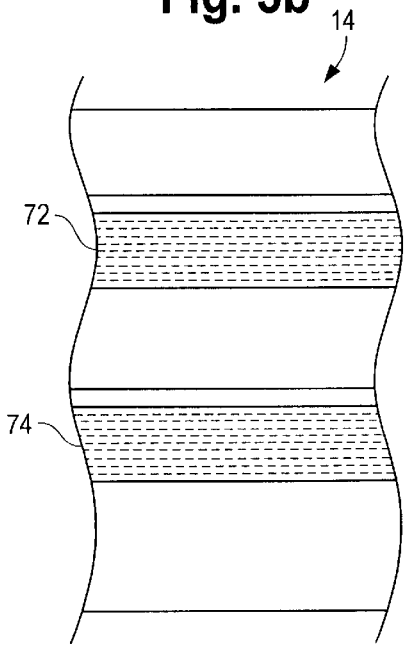

Referring now to FIGS. 1 and 5, the base molding portion 14 is a finishing element that will be readily recognized by those skilled in the art. The molding portion 14 includes a main or central body 66 integral with an upper curved cove portion 68 that is configured to extend to and rest against or abut the wall W. A lower curved cove portion 70 is integral with the central body 66 and extends in a direction opposite to that of the upper cove 68, curving downwardly, away from the wall W to meet the floor F.

As will be understood, it is important that the molding 14 meet the floor F in a precise manner. That is, the molding 14 cannot be mounted to the wall W so that a large space results between the molding and the floor F. Nor can the molding be mounted to the wall W such that it is compressed to "fit" to the floor F. Either of these instances results in an unacceptable installation, having an unprofessional and amateur-like appearance.

The present two-part base molding system 10 overcomes this, as well as other problems by providing a readily installed, easily changeable base molding portion 14 that mounts to the permanently installed wall mount 12. Similar to the mount 12, the molding portion 14 includes integrally formed engaging elements 72, 74, 78, 80 that extend outwardly from a rear surface 76 of the main body 66 of the molding portion 14.

The molding portion includes molding engaging elements 72, 74, 78, 80 that are configured to cooperate with the mounting engaging elements 30, 32, 38, 40. In particular, as described below, when the molding portion 14 is mounted to the mount 12, the molding engaging elements 72, 74, 78, 80 are configured to provide a secure and structurally sound connection.

Like the mounting engaging elements 30, 32, 38, 40, the molding portion 14 can incorporate first and second continuous molding engaging elements 72, 74, or may incorporate first and second sets of discrete molding engaging elements 78, 80.

Several configurations are possible. For example, and not by way of limitation: (1) the mounting portion 12 may incorporate continuous mounting elements 30, 32 while the molding portion incorporates sets of discrete molding elements 78, 80, (2) the mounting portion 12 may incorporate sets of discrete mounting elements 38, 40 while the molding portion 14 incorporates continuous molding elements 72, 74, (3) both the mounting and molding portions 12, 14 can both use continuous mounting and molding elements 30, 32, 72, 74, or (4) both the mounting and molding portions 12, 14 can both use sets of discrete mounting and molding elements 38, 40, 78, 80.

The specific configuration is not of particular importance. As described below, the molding and mounting elements 30, 32, 38, 40, 72, 74, 78, 80 need only cooperate with one another to provide a secure and structurally sound connection.

Thus, if first and second continuous molding engaging elements 72, 74 are used, they should be configured and positioned to cooperate with the mounting engaging elements that are used 30, 32, 38, 40. The first and second continuous molding engaging elements 72, 74 should be substantially aligned with the first and second continuous mounting elements 30, 32, if continuous mounting engaging elements 30, 32 are used. Alternatively, the first and second continuous molding engaging elements 72, 74 should be substantially positioned along first and second horizontal molding lines $HMd_1$, $HMd_2$ that are substantially aligned with the first and second horizontal mounting lines $HM_1$, $HM_2$ if sets of discrete mounting engaging elements 38, 40 are used.

Likewise, if first and second sets of discrete molding engaging elements 78, 80 are used they should be configured and positioned to cooperate with the mounting engaging elements 30, 32, 38, 40 that are used. Each element $EMd_1$, $EMd_2$ of the first and second sets of discrete molding engaging elements 78, 80 are substantially positioned along first and second molding horizontal lines $HMd_1$, $HMd_2$ that line up with the first and second mounting horizontal lines $HM_1$, $HM_2$, if sets of discrete mounting engaging elements 38, 40 are used. Alternatively, the first and second sets of discrete molding engaging elements 78, 80 should be substantially aligned with the first and second continuous mounting engaging elements 30, 32, if continuous mounting engaging elements 30, 32 are used. Also, each element $EMd_1$ of the first set of discrete molding engaging elements 78 is substantially horizontally aligned with a corresponding element $EMd_2$ of the second set of discrete molding engaging elements 80.

In a most preferred embodiment, the molding engaging elements 72, 74, 78, 80 are configured similar to the most preferred version 46*a* of the mount engaging elements 30, 32, 38, 40. That is, the molding engaging elements 72, 74, 78, 80 each have a hook-like configuration 46*b* that defines an engaging surface 42*b*. The engaging surfaces 42*b* are preferably formed having serrations 52*b* therealong that mate with or engage the serrations 52*a* of the mount engaging elements 30, 32, 38, 40. Most preferably, free legs 50*b* of the molding portion engaging elements 14 have a width $W_f$ that is less than the distance $d_f$ between the mounting portion engaging element free legs 50*a* so that the molding portion engaging elements 72, 74, 78, 80 readily insert into and lock to the mount engaging elements 30, 32, 38, 40. Preferably, the free legs 50*b* of the molding portion 14 are slightly tapered and terminate at a point 58*b*.

In addition, as can be seen from FIG. 1, an outer surface 44 of each molding engaging element, that is, that surface 44 of each molding engaging element 14 that is opposingly oriented relative to its inner surface 42, can substantially abut the mount 12 at the outer surface 34 of the mount 12—between the mount engaging element 30, 32, 38, 40 and the outer surface of the mount 34. On other embodiments not shown, the outer surface 44 of each molding element need not substantially abut the outer surface of the mount. Likewise, an outer surface 44 of each mount engaging element 30, 32, 38, 40, that is, that surface 44 of each mount engaging element 14 that is opposingly oriented relative to its inner surface 42, substantially abuts the molding portion 14 at its rear surface 76—between the molding engaging element 72, 74, 78, 80 and the rear surface 76 of the molding portion 14. The inner surfaces 42—and in a preferred version, the engaging surfaces 42*a*, 42*b*—of the mounting and molding engaging elements 30, 32, 38, 40, 72, 74, 78, 80 substantially abut one another. For purposes of this disclosure, the terms "substantially abuts" or "substantially abutting" shall mean that at least some portion of the surface or thing is in contact with the surface or thing of which it is adjacent. The terms "substantially abuts" or "substantially abutting" should not be construed to require that the entirety of the surface or thing is in abutting relation to the other surface or thing. This abutting arrangement provides a structurally sound connection between the molding portion 14 and the mount 12.

As will be apparent from the figures, and in particular, FIG. 1, the lower coved portion 70 is configured so that the molding 14, when mounted to the mount 12, will rest on the floor F surface, without a gap or space between the floor F and the molding 14, and without compressing the molding 14 against the floor F. This configuration permits installation of the molding 14 without the need for detailed measurements and layout.

In mounting portion embodiments 36 that incorporates set(s) of discrete mounting engaging elements 38, 40 or a plurality of spacing elements 64, the mount 36 is formed from a polymeric material, such as styrene, using well known injection molding processes. In other embodiments 12 that incorporate continuous mounting engaging elements 30, 32 and a continuous spacing element 62, the mount 12 is formed from, for example, polyvinyl chloride (PVC) using an extrusion molding process.

Likewise, the molding portion 14 is formed from, for example, polyvinyl chloride (PVC) using an extrusion molding process in the embodiment that incorporates continuous engaging elements 72, 74, and formed from the well known injection molding process in embodiments that incorporate set(s) of discrete molding engaging elements 78, 80. As will be recognized by those skilled in the art, if the mounting and molding portions 12, 14 are extruded, the mounting and molding engaging elements 30, 32, 72, 74 will be formed as continuous strips or flange-like elements. These flange-like elements 30, 32, 72, 74 are integrally formed with the mount 12 and the main body portion 66 of the molding portion 14, and extend the length of the particularly formed mounting or molding portion 12, 14. To this end, longitudinal adjustment of the molding portion 14 is readily carried out, in that the molding 14 can be installed to the mount 12 anywhere along its length.

The molding portion 14 is removable from the mount 12 with minimal effort and with no damage to the wall W surface. Because the molding portion 14 is formed from PVC, it can be manufactured having a relatively high degree of strength, and at the same time, flexibility, so that pressure applied to the molding 14, inwardly toward the wall W, urges the molding portion 14 engaging elements outwardly, away from the wall W. With the engaging elements 72, 74, 78, 80 in this orientation, the molding portion 14 can be removed from the mount 12 to, for example, perform maintenance, such as painting, on the wall W, without damage to the molding or to the wall W.

Advantageously, as best seen in FIG. 1, when installed, a space, as indicated at 82, is defined between the molding portion 14 and the mount 12. This space 82 extends the length of the installed molding 14. To this end, narrow gauge cabling 16, such as telephone wiring 16, that otherwise may be fastened to the wall W, can be installed between the molding 14 and the mount 12 or wall W. Not only does this arrangement enhance the aesthetics of the installation, but it also provides for easier maintenance of the cabling or wires 16, in that fasteners that are typically used to secure these cables to the wall are no longer needed, and thus do not have to be removed from the wall to access the cabling or wires.

From the foregoing it will be observed that numerous modifications and variations can be effectuated without departing from the true spirit and scope of the novel concepts of the present invention. It is to be understood that no limitation with respect to the specific embodiment illustrated is intended or should be inferred. The disclosure is intended to cover by the appended claims all such modifications as fall within the scope of the claims.

What is claimed is:

1. A two-part base molding system comprising:

a mounting portion including two sets of discrete mounting engaging elements extending from the mounting portion, the mounting portion having an outer surface, the two sets of discrete mounting engaging elements having inner and outer surfaces, each discrete mounting engaging element being horizontally spaced from the mounting engaging element of its respective set; and a molding portion mountable to the mounting portion, the molding portion including two sets of discrete molding engaging elements extending from the molding portion, the molding portion having a rear surface, the two sets of discrete molding engaging elements having inner and outer surfaces, each discrete molding engaging element being horizontally spaced from the molding engaging element of its respective set;

wherein, when the molding portion is mounted to the mounting portion, the inner surfaces of the mounting and molding engaging elements substantially abut one another, and the outer surface of the mounting engaging elements substantially abuts the rear surface of the molding portion.

2. The two-part base molding system in accordance with claim 1 wherein the mounting and molding portions include upper and lower portions vertically spaced from one another, the upper and lower mounting portions being solid.

3. The two-part base molding system in accordance with claim 2 wherein a plurality of fastener openings are formed within the mounting portion and are positioned at the vertical space between the upper and lower portions of the mounting portion.

4. The two-part base molding system in accordance with claim 3 wherein the vertical space between the upper and lower portions is about 19 mm, and the fastener openings are countersunk.

5. The two-part base molding system in accordance with claim 1 wherein the mounting portion includes at least one spacing element protruding from a bottom end of the mounting portion.

6. The two-part base molding system in accordance with claim 5 wherein the at least one spacing element is a continuous leg.

7. The two-part base molding system in accordance with claim 5 wherein the at least one spacing element is a plurality of legs horizontally spaced from one another.

8. The two-part base molding system in accordance with claim 1 wherein both the mounting and molding portions include first and second continuous engaging elements, the first and second continuous mounting engaging elements extending from the upper and lower portions of the mounting portion.

9. The two-part base molding system in accordance with claim 1 wherein each element of the first set of discrete mounting engaging elements is positioned substantially along a first horizontal mounting line, each element of the second set of discrete mounting engaging elements is positioned substantially along a second horizontal mounting line, each element of the first set of discrete molding engaging elements is positioned substantially along a first horizontal molding line, each element of the second set of discrete molding engaging elements is positioned substantially along a second horizontal molding line, each element of the first set of discrete mounting engaging elements is substantially horizontally aligned with a corresponding element of the second set of discrete mounting engaging elements, and each engaging element of the first set of discrete molding engaging elements is substantially horizontally aligned with a corresponding engaging element of the second set of discrete molding engaging elements.

10. The two-part base molding system in accordance with claim 1 wherein the mounting and molding engaging elements include engaging surfaces with serrations formed thereon.

11. The two-part base molding system in accordance with claim 1 wherein each of the mounting and molding engaging elements are formed having a hook-like configuration including a base portion extending transversely from the mounting portion and the molding portion and a free leg portion contiguous with the base portion.

12. The two-part base molding system in accordance with claim 11 wherein the free leg portions of the mounting and molding engaging elements are slightly tapered and terminate at a point.

13. The two-part base molding system in accordance with claim 1 wherein the molding portion mounts to the mounting portion to define a space therebetween.

14. The two-part base molding system in accordance with claim 1 wherein the outer surface of the molding engaging elements substantially abuts the outer surface of the mounting portion.

15. A two-part base molding system comprising:

a mounting portion including solid upper and lower portions vertically spaced from one another, a plurality of fastener openings being formed within the mounting portion and positioned at the vertical space between the upper and lower solid portions, the upper mounting portion including a first continuous mounting engaging element extending therefrom, and the lower portion including a second continuous mounting engaging element extending therefrom, the mounting portion having an outer surface, and the first and second continuous mounting engaging elements having inner and outer surfaces; and a molding portion including first and second sets of discrete molding engaging elements extending therefrom, the first and second sets being vertically spaced from one another, the molding portion having an outer surface, and each element of the first and second sets of discrete molding engaging elements having inner and outer surfaces;

wherein when the molding portion is mounted to the mounting portion, the inner surfaces of the first and second mounting and molding engaging elements substantially abut one another, and the outer surfaces of the first and second mounting engaging elements substantially abut the rear surface of the molding portion.

16. The two-part base molding system in accordance with claim 15 wherein the outer surfaces of the first and second molding engaging elements substantially abut the outer surface of the mounting portion.

17. A two-part base molding system comprising an extruded, substantially longitudinally continuous mounting portion including at least one mounting engaging element extending from the mounting portion, the mounting portion having a substantially continuous outer surface, the mounting engaging element having substantially continuous inner and outer surfaces; and an extruded, substantially longitudinally continuous molding portion mountable to the mounting, the molding portion including at least one molding engaging element extending from the molding portion, the molding portion having a substantially continuous rear surface, the at least one molding engaging elements having substantially continuous inner and outer surfaces;

wherein, when the molding portion is mounted to the mounting portion, the substantially continuous inner surfaces of the at least one mounting and molding engaging elements substantially abut one another, the substantially continuous outer surface of the at least one mounting engaging element substantially abuts the substantially continuous rear surface of the molding portion, and the molding portion is readily adjustable longitudinally with respect to the mounting portion.

18. The two-part base molding system in accordance with claim 17 wherein the extruded, substantially longitudinally continuous mounting portion includes first and second parallel spaced apart mounting engaging elements and wherein the extruded, substantially longitudinally continuous molding portion includes first and second parallel, spaced apart molding engaging elements, each engageable with a respective one of the first and second mounting engaging elements.

* * * * *